US006319055B1

(12) United States Patent
Conner, Jr.

(10) Patent No.: US 6,319,055 B1
(45) Date of Patent: Nov. 20, 2001

(54) JUMPER CABLE SYSTEM

(76) Inventor: John A. Conner, Jr., 103 Perdido Cir., Niceville, FL (US) 35278

( * ) Notice: Subject to any disclaimer, the term of this patent is extended or adjusted under 35 U.S.C. 154(b) by 0 days.

(21) Appl. No.: 09/489,255

(22) Filed: Jan. 21, 2000

(51) Int. Cl.[7] ..... H01R 11/00
(52) U.S. Cl. ..... 439/504
(58) Field of Search ..... 439/754, 669, 439/755, 756, 35, 504; 429/1, 90, 121, 179

(56) References Cited

U.S. PATENT DOCUMENTS

| | | | | |
|---|---|---|---|---|
| 3,942,027 | * | 3/1976 | Fima | 307/10 |
| 4,006,952 | * | 2/1977 | Puckett | 439/5 |
| 4,079,304 | * | 3/1978 | Brandenburg | 320/25 |
| 4,185,204 | * | 1/1980 | Fima | 307/10 |
| 4,261,634 | * | 4/1981 | Robinson | 439/147 |
| 4,405,190 | | 9/1983 | Schraeder | 339/28 |
| 4,647,139 | | 3/1987 | Yang | 339/154 A |
| 4,700,961 | * | 10/1987 | Thomas et al. | 280/152 |
| 4,726,786 | * | 2/1988 | Hill | 439/504 |
| 4,759,728 | * | 7/1988 | Cobb | 439/503 |
| 4,885,524 | * | 12/1989 | Wilburn | 320/25 |
| 4,904,205 | | 2/1990 | Rice | 439/504 |
| 5,180,310 | * | 1/1993 | Miller | 439/34 |
| 5,367,243 | * | 11/1994 | Wells et al. | 320/2 |
| 5,496,657 | * | 3/1996 | Dixon, Jr. | 439/62 |
| 5,635,818 | * | 6/1997 | Quintero | 320/25 |
| 5,766,020 | | 6/1998 | Hughes | 439/35 |
| 5,921,809 | * | 7/1999 | Fink | 439/504 |

* cited by examiner

*Primary Examiner*—Tulsidas Patel
(74) *Attorney, Agent, or Firm*—Peter Loffler

(57) ABSTRACT

A jumper cable system allows a person to jump start one vehicle from another vehicle without coming into the proximity of either vehicles' batteries. The jumper cable system has a pair of receptacles each attached to one of the vehicles remote of the vehicle's battery, and each having a first pin electrically connected to respective vehicle's positive battery terminal and a second pin electrically connected to the respective vehicle's negative battery terminal (or ground to the chassis). A pair of plugs each receive an end of a first jumper cable and a second jumper cable, Each plug has a first opening that removably receives the first pin and a second opening that removably receives the second pin of one of the receptacles.

9 Claims, 2 Drawing Sheets

JUMPER CABLE SYSTEM

BACKGROUND OF THE INVENTION

1. Field of the Invention

The present invention relates to a jumper cable system for jump starting one vehicle from the electrical power of another vehicle.

2. Background of the Prior Art

If a vehicle's battery becomes dead, the usual procedure is to jump start the vehicle from another vehicle. A set of jumper cables are connected between the two vehicles and the live vehicle provides the starting electrical power for the dead vehicle. While this system is tried and true, it is not without its drawbacks. As the jumper cables are attached directly to the battery, the person performing this task is placed in harm's way should the battery explode, a not totally uncommon event. Additionally, the jumper cables can be mis-attached wherein a jumper cable that is meant to be attached to a positive terminal is attached to a negative terminal, or vice versa. Such a situation creates the potential for battery explosion as well as damage to one or both vehicles.

In order to reduce the risk for injury or damage during the jump start procedure, various jumper cable systems have been proposed. However, the proposed systems are unreliable in operation, or are unduly complex to use, or are of relatively complex design and construction resulting in a relatively expensive jumper cable system.

Therefore, there is a need in the art for a jumper cable system that addresses the above-mentioned problems in the art. Such a jumper cable system must reduce the risk of injury to a user resulting from a battery explosion. Such a system must be of relatively simple and straightforward design and construction and must be relatively easy to use. The jumper cable system must be able to prevent cross wiring of the negative and positive terminals of the two batteries to be connected.

SUMMARY OF THE INVENTION

The jumper cable system of the present invention addresses the aforementioned needs in the art. The jumper cable system reduces the risk of injury to a user resulting from a battery explosion by removing the user away from each battery during battery connection. The jumper cable system is of relatively simple and straightforward design and construction and is relatively easy to use. The jumper cable system prevents cross wiring of the negative and positive terminals of the two batteries to be connected.

The jumper cable system of the present invention is comprised of a first receptacle having a first pin with a first cross section attached to the first receptacle, the first pin adapted to be attached to a first battery cable attached to the positive terminal of a first battery. A second pin with a second cross section, lesser than the first cross section, is attached to the first receptacle, the second pin adapted to be attached to a second battery cable attached to the negative terminal of the first battery. A second receptacle has a third pin with the first diameter attached to the second receptacle, the third pin adapted to be attached to a third battery cable attached to the positive terminal of a second battery. A fourth pin with the second diameter is attached to the second receptacle, the fourth pin adapted to be attached to a fourth battery cable attached to the second negative terminal of the second battery. A first jumper cable has a first end and a second end, while a second jumper cable has a third end and a fourth end. A first plug has a first opening electrically connected to the first end of the first jumper cable, the first pin removably receivable within the first opening, the first plug also having a second opening electrically connected to the third end of the second jumper cable, the second pin removably receivable within the second opening. A second plug has a third opening electrically connected to the second end of the first jumper cable, the third pin removably receivable within the third opening, the second plug also having a fourth opening electrically connected to the fourth end of the second jumper cable, the fourth pin removably receivable within the fourth opening. The first pin, the second pin, the third pin, and the fourth pin may all be generally cylindrical and may have a rounded end. The first jumper cable is electrically connected to the first opening by a first socket, the first jumper cable is electrically connected to the second opening by a second socket, the second jumper cable is electrically connected to the third opening by a third socket, and the second jumper cable is electrically connected to the fourth opening by a fourth socket. A first flange having a first opening is attached to the first receptacle and is used to attach the first receptacle to the first vehicle, while a second flange having a second opening is attached to the second receptacle and is used to attach the first receptacle to the second vehicle. The first pin and the second pin are attached to the first receptacle via a first dielectric plate, while the third pin and the fourth pin are attached to the second receptacle via a second dielectric plate.

BRIEF DESCRIPTION OF THE DRAWINGS

Similar reference numerals refer to similar parts throughout the several views of the drawings.

DESCRIPTION OF THE PREFERRED EMBODIMENT

Figure 1:
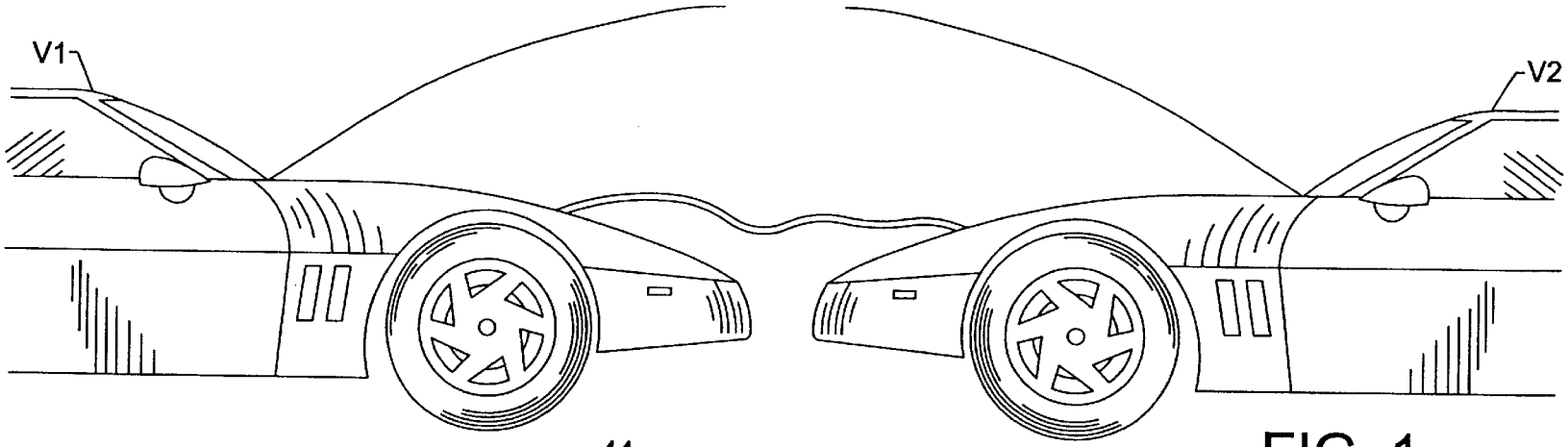
FIG. 1 is an environmental view of the jumper cable system of the present invention connected between two vehicles.
Figure 2:
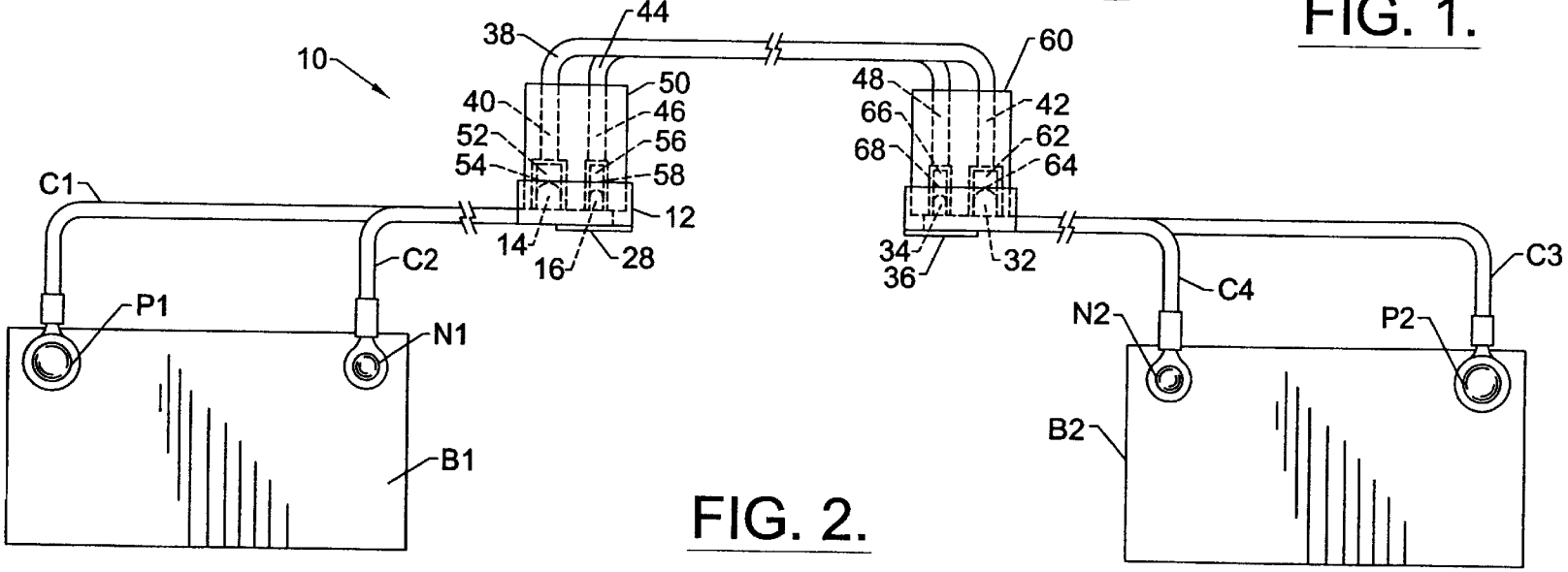
FIG. 2 illustrates the jumper cable system of the present invention connected between two batteries.
Figure 3:
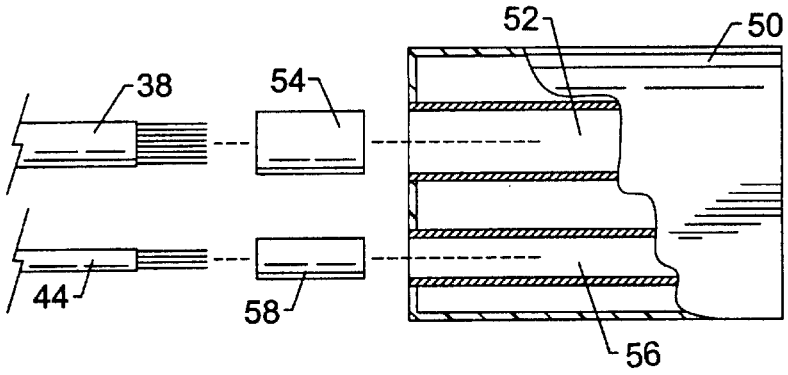
FIG. 3 is an exploded view of the plug.

Referring now to the drawings, it is seen that the jumper cable system of the present invention, generally denoted by reference numeral 10, is comprised of a first receptacle 12 having a first pin 14 with a first cross section, attached to the first receptacle 12. The first receptacle 12 has a shape that is not symmetrical on at least one axis. The first pin 14 is attached to a first battery cable C1 attached to the positive terminal P1 of a first battery B1. A second pin 16 with a second cross section, lesser (or greater) than the first cross section, is attached to the first receptacle 12. The second pin 16 is attached to a second battery cable C2 attached to the negative terminal N1 of the first battery B1. The first pin 14 and second pin 16 are attached to the first receptacle 12 by providing a first dielectric plate 18 attached to the first receptacle 12 with the connector ring R1 of the first battery cable C1 sandwiched between the first dielectric plate 18 and the base 20 of the first pin 14 and the connector ring R2 of the second battery cable C2 sandwiched between the first dielectric plate 18 and the base 22 of the second pin 16. A second dielectric plate 24 sandwiches the bases 20 and 22 of the first pin 14 and second pin 16 respectively to the first dielectric plate 18, and a retainer clip 26 holds the two dielectric plates 18 and 24 and the bases 20 and 22 of the two pins 14 and 16 respectively to the first receptacle 12. A first flange 28 is attached to the first receptacle 12, the first flange 28 being used to attach the first receptacle 12 to a first vehicle V1 at any desired location. This location can be within the engine compartment, the trunk, the passenger compartment or any other desired location, and can protrude through a body panel of the vehicle V1.

Figure 4:
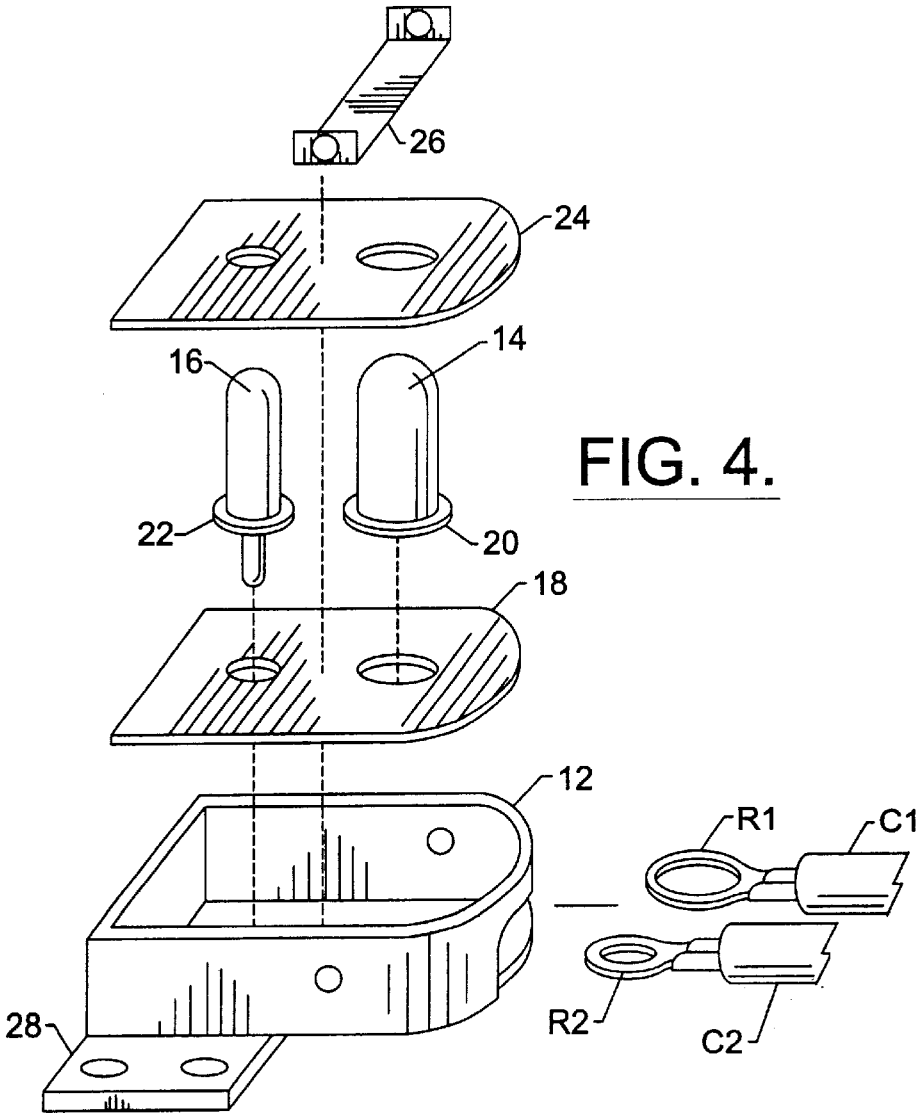
FIG. 4 is an exploded view of the power receptacle.

A second receptacle 30 has a third pin 32 with the first diameter attached to the second receptacle 30. The third pin 32 is attached to a third battery cable C3 attached to the positive terminal P2 of a second battery B2. The second receptacle 30 has a shape that is not symmetrical on at least one axis and is generally similar to the shape of the first receptacle 12. A fourth pin 34 with the second diameter is attached to the second receptacle 30. The fourth pin 34 is attached to a fourth battery cable C4 attached to the second negative terminal N2 of the second battery B2. The third pin 32 and the fourth pin 34 are attached to the second receptacle 30 in similar fashion to the attachment of the first pin 14 and the second pin 16 in that a third dielectric plate is attached to the second receptacle with the connector ring of the third battery cable C3 sandwiched between the third dielectric plate and the base of the third pin and the connector ring of the fourth battery cable C4 sandwiched between the third dielectric plate and the base of the fourth pin while a fourth dielectric plate sandwiches the bases and of the third pin and fourth pin respectively to the third dielectric plate, and a retainer clip holds both dielectric plates and the bases and of the two pins and respectively to the second receptacle 30 (none of the various parts illustrated in detailed but substantially similar to the structure of the first receptacle and associated components as best illustrated in FIG. 4). A second flange 36 is attached to the second receptacle 30, the second flange 36 being used to attach the second receptacle 30 to a second vehicle V2 at any desired location. This location can be within the engine compartment, the trunk, the passenger compartment or any other desired location, and can protrude through a body panel of the vehicle V2.

The first pin 14, the second pin 16, the third pin 32, and the fourth pin 34 may all be generally cylindrical and may have a rounded end.

A first jumper cable 38 has a first end 40 and a second end 42, while a second jumper cable 44 has a third end 46 and a fourth end 48. A first plug 50, which has a shape that corresponds to the shape of the first receptacle 12, has a first opening 52 electrically connected to the first end 40 of the first jumper cable 38, the first end 40 being attached to the first plug 50 via a first socket 54. The first pin 14 is removably receivable within the first opening 52. The first plug 50 has a second opening 56 electrically connected to the third end 46 of the second jumper cable 44, the third end 46 being attached to the first plug 50 via a second socket 58. The second pin 16 is removably receivable within the second opening 56. A second plug 60, which has a shape that corresponds to the shape of the second receptacle 30, has a third opening 62 electrically connected to the second end 42 of the first jumper cable 38, the second end 42 being attached to the second plug 60 via a third socket 64. The third pin 32 is removably receivable within the third opening 62. The second plug 60 has a fourth opening 66 electrically connected to the fourth end 48 of the second jumper cable 44, the fourth end 48 being attached to the second plug 60 via a fourth socket 68. The fourth pin 34 is removably receivable within the fourth opening 66.

In order to use the jumper cable system 10 of the present invention, the first receptacle 12 is attached, via the first flange 28, to a first vehicle V1. The first battery cable C1 is attached to the positive terminal P1 of the battery B1 of the first vehicle V1. The second battery cable C2 is attached to the negative terminal N1 of the battery B1 of the first vehicle V1. The second receptacle 30 is attached, via the second flange 36, to a second vehicle V2. The third battery cable C1 is attached to the positive terminal P2 of the battery B2 of the second vehicle V1. The fourth battery cable C4 is attached to the negative terminal N2 of the battery B2 of the first vehicle V2. When the first vehicle V1 needs a jump start, the second vehicle V2 is brought into proximity with the first vehicle V1. The first plug 50 is attached to the first receptacle 12 such that the first pin 14 is received within the first opening 52 and the second pin 16 received within the second opening 54. As each pin 14 and 16 has a different cross section, and as each opening 52 and 54 has a corresponding cross section to its respective pin 14 and 16, and as the shape of the first receptacle 12 is not symmetrical on at least one axis and corresponds to the shape of the first plug 50, it is not possible to mis-attach the plug 50 to the receptacle 12. Additionally, the second plug 60 is attached to the second receptacle 30 such that the third pin 32 is received within the third opening 62 and the fourth pin 34 is received within the fourth opening 66. As each pin 32 and 34 has a different cross section, and as each opening 62 and 66 has a corresponding cross section to its respective pin 32 and 34, and as the shape of the second receptacle 30 is not symmetrical on at least one axis (and has the same shape as the first receptacle 12) and corresponds to the shape of the second plug 60 (which has the same shape of the first plug 50), it is not possible to mis-attach the second plug 60 to the second receptacle 30 (it is recognized that in alternate form, the negative terminals of one or both batteries may be ground to the chassis of its respective vehicle instead). The dead vehicle is now electrically connected to the live vehicle and is jump started in the usual way.

While the invention has been particularly shown and described with reference to an embodiment thereof, it will be appreciated by those skilled in the art that various changes in form and detail may be made without departing from the spirit and scope of the invention.

I claim:

1. A jumper cable system for connecting a first battery having a first positive terminal and a first negative terminal with a second battery having a second positive terminal and a second negative terminal, the jumper cable system comprising:

a first receptacle;

a first plate;

a second plate having a first opening and a second opening;

a first pin having a first base and a first cross section, the first pin adapted to be attached to a first battery cable attached to the first positive terminal;

a second pin having a second base and a second cross section, the second pin adapted to be attached to a second battery cable attached to the first negative terminal;

the first base and the second base positioned between the first plate and the second plate such that the first pin protrudes through the first opening and the second pin protrudes through the second opening; the first plate and the second plate secured to the first receptacle by a first retainer clip;

a second receptacle;

a third plate;

a fourth plate having a first opening and a second opening;

a third pin having a third base and the first cross section, the third pin adapted to be attached to a third battery cable attached to the second positive terminal;

a fourth pin having a fourth base and the second cross section, the fourth pin adapted to be attached to a fourth battery cable attached to the second negative terminal;

the third base and the fourth base positioned between the third plate and the fourth plate such that the third pin protrudes through the third opening and the fourth pin protrudes through the fourth opening; the third plate and the fourth plate secured to the second receptacle by a second retainer clip;

a first jumper cable having a first end and a second end;

a second jumper cable having a third end and a fourth end;

a first plug having a first opening electrically connected to the first end of the first jumper cable, the first pin removably receivable within the first opening, the first plug having a second opening electrically connected to the third end of the second jumper cable, the second pin removably receivable within the second opening; and a second plug having a third opening electrically connected to the second end of the first jumper cable, the third pin removably receivable within the third opening, the second plug having a fourth opening electrically connected to the fourth end of the second jumper cable, the fourth pin removably receivable within the fourth opening.

2. The jumper cable system as in claim 1 wherein the first cross section is different than the second cross section.

3. The jumper cable system as in claim 1 wherein the first cross section is greater than the second cross section.

4. The jumper cable as in claim 1 wherein the first pin, the second pin, the third pin, and the fourth pin are all generally cylindrical.

5. The jumper cable system as in claim 1 further comprising:

first flange having a first opening attached to the first receptacle; and a second flange having a second opening attached to the second receptacle.

6. The jumper cable system as in claim 1 wherein the first plate is made from a dielectric material and is attached to the first receptacle, the first pin, and the second pin and the second plate is made from a dielectric material and is attached to the second receptacle, the third pin, and the fourth pin.

7. The jumper cable system as in claim 1 wherein the first receptacle has a shape that is not symmetrical on at least one axis and the first plug has a corresponding shape and the second receptacle has a shape that is not symmetrical on at least one axis and the second plug has a corresponding shape.

8. The jumper cable as in claim 4 wherein the first pin, the second pin, the third pin, and the fourth pin all have a generally rounded end.

9. The jumper cable as in claim 1 wherein the first jumper cable is electrically connected to the first opening by a first socket, the first jumper cable is electrically connected to the second opening by a second socket, the second jumper cable is electrically connected to the third opening by a third socket, and the second jumper cable is electrically connected to the fourth opening by a fourth socket.

* * * * *